United States Patent [19]

Ernst-Cox et al.

[11] Patent Number: 5,047,273

[45] Date of Patent: Sep. 10, 1991

[54] PLUG STRUCTURE

[76] Inventors: Julie C. Ernst-Cox; Mark F. Cox, both of 70 Lake Major Rd., Dartmouth, N.S., Canada, B2W 3X7

[21] Appl. No.: 439,142

[22] Filed: Nov. 20, 1989

[51] Int. Cl.[5] ..... B65D 39/00

[52] U.S. Cl. ..... 428/63; D9/439; 206/307; 428/537.1

[58] Field of Search ..... 428/119, 63, 455, 537.1; 206/307, 457; 242/68.6; D9/439

[56] References Cited

U.S. PATENT DOCUMENTS

| | | | |
|---|---|---|---|
| D. 42,519 | 5/1912 | Weis | D9/439 |
| D. 46,488 | 9/1914 | Wolfson | D9/439 |
| D. 177,774 | 5/1956 | Stroup | D9/439 |
| 4,255,475 | 3/1981 | Del Grande | 428/44 |
| 4,460,087 | 7/1984 | De Marco et al. | 206/415 |
| 4,484,715 | 11/1984 | De Marco et al. | 242/68.6 |
| 4,522,856 | 6/1985 | Paisley et al. | 428/455 X |
| 4,547,417 | 10/1985 | De Marco et al. | 428/64 |
| 4,602,971 | 7/1986 | Bergeron et al. | 428/40 X |

*Primary Examiner*—Henry F. Epstein
*Attorney, Agent, or Firm*—Leon Gilden

[57] ABSTRACT

A structure is set forth comprising a cylindrical base member wherein the grain structure is aligned parallel to an axis defined by the cylindrical base, wherein various cap structures are provided, wherein each cap structure extends beyond the aforenoted cylindrical base and the cap structures are defined by a square pyramidal structure, a square parallelepiped structure, a triangular pyramidal structure, as well as arcuate structures to enhance and minimize finishing steps required in the completion of wooden structures and enhance their value and aesthetic appeal. A modified plug structure utilizes radial compression grooves formed within the cylindrical base, wherein the compression grooves are provided with an adhesive that upon directing the base into a companion bore, directs the adhesive exteriorly of the grooves into communication with the bore to affix the plug with the bore.

4 Claims, 5 Drawing Sheets

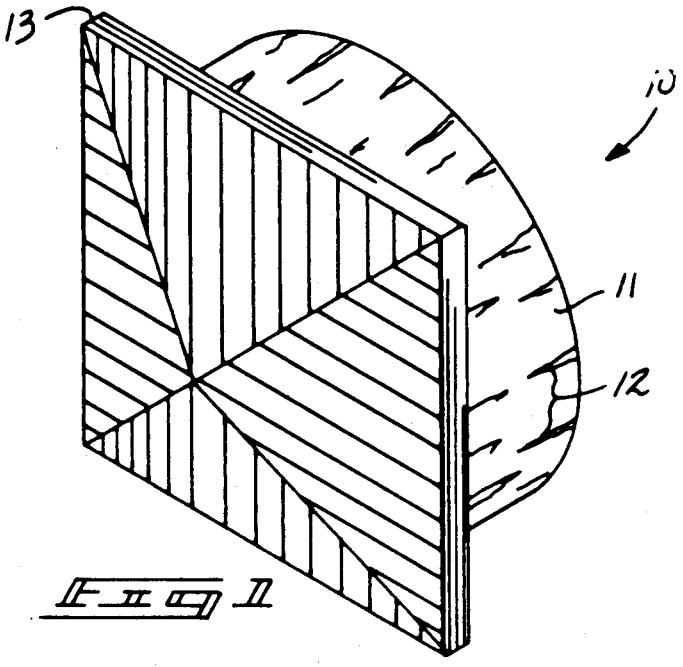
Fig 1
Fig 2
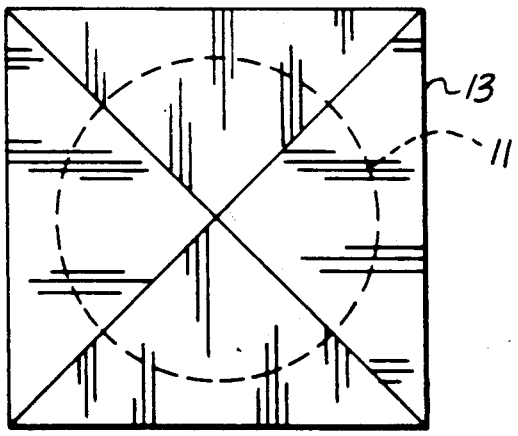
Fig 3
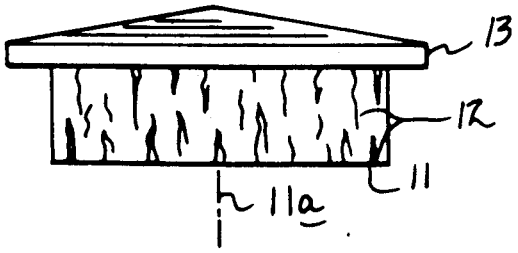

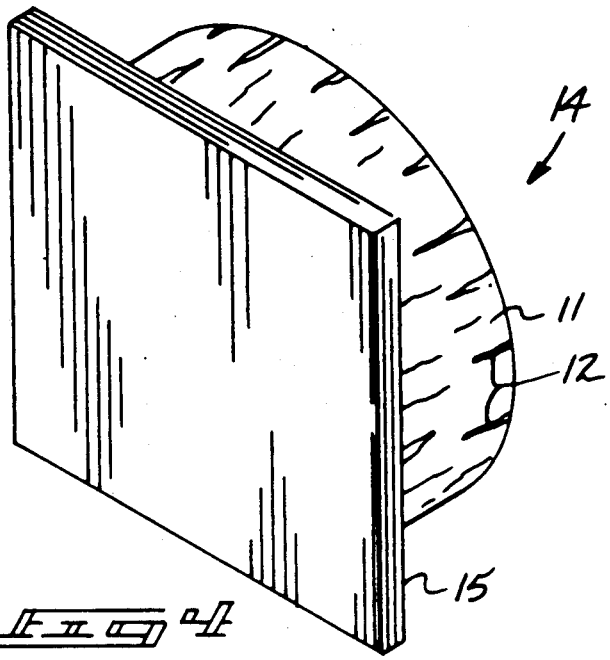
Fig 4
Fig 5
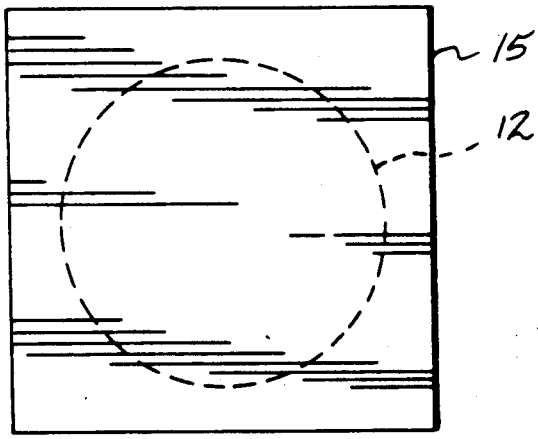
Fig 6
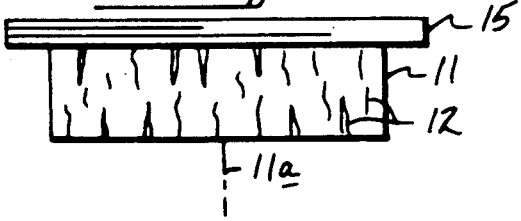

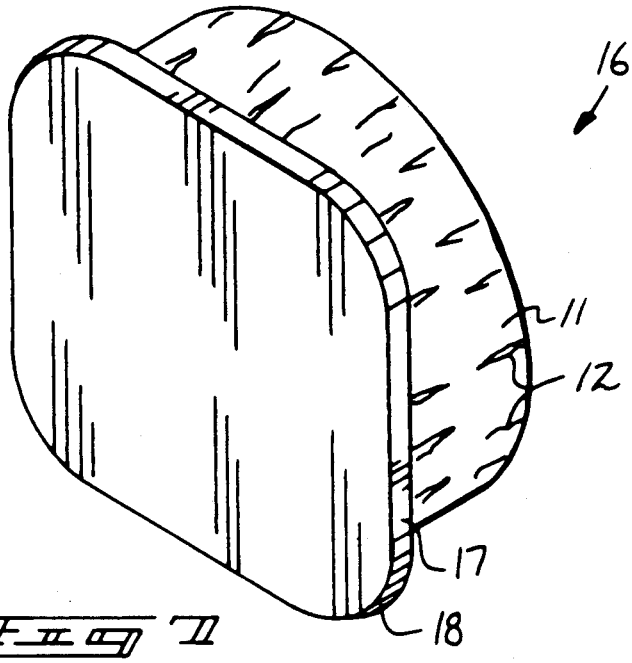
Fig 7
Fig 8
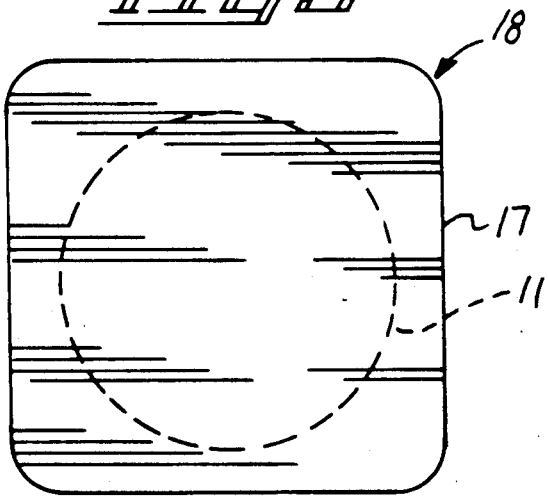
Fig 9
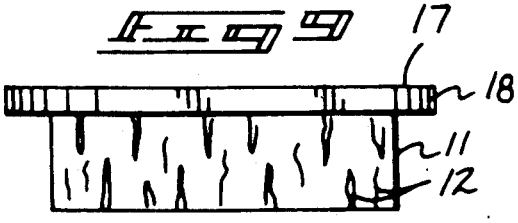

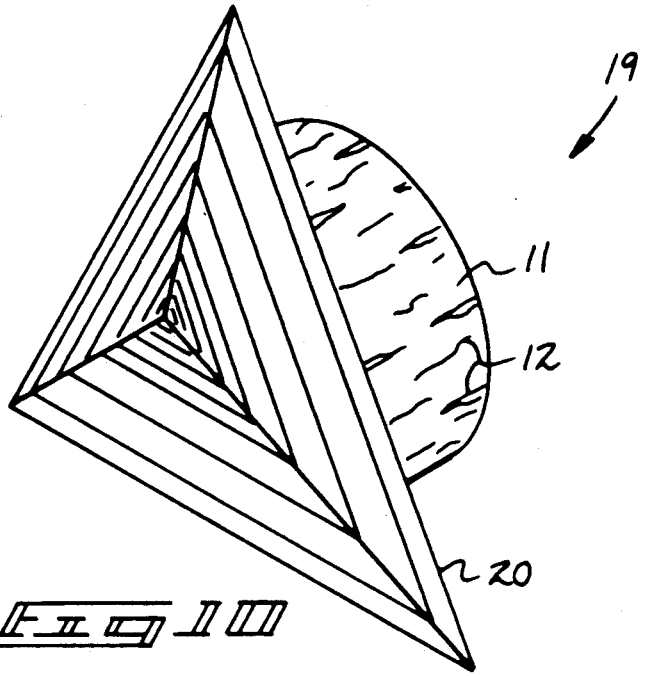
Fig 10
Fig 11
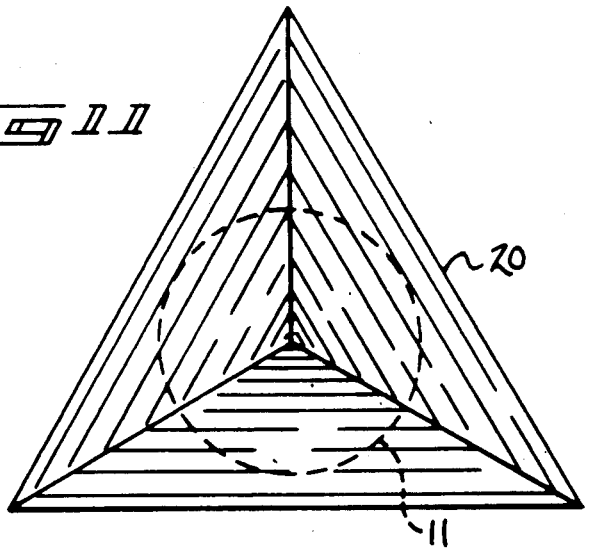
Fig 12
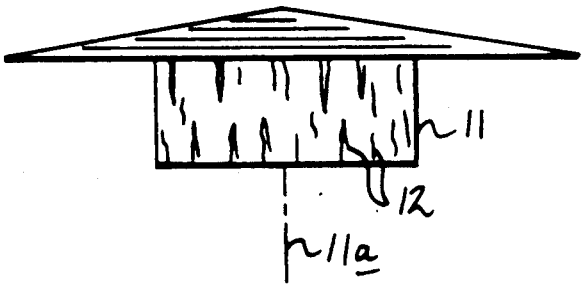

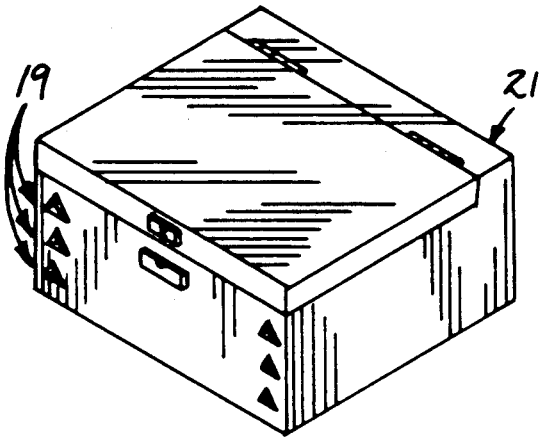
Fig 13
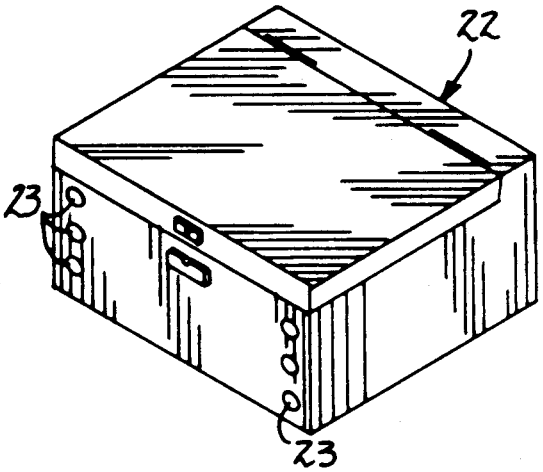
Fig 14
Fig 15
Fig 16
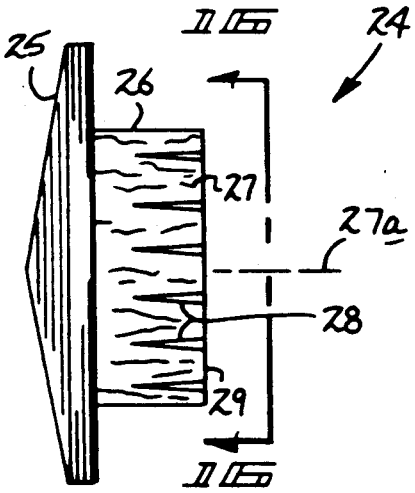
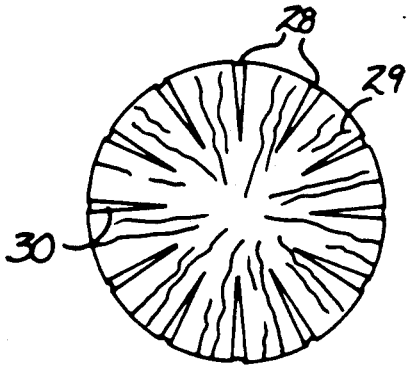

PLUG STRUCTURE

BACKGROUND OF THE INVENTION

1. Field of the Invention

The field of invention relates to plug structures, and more particularly pertains to a new and improved plug structure wherein the same provides variously configured caps to minimize finishing work required in wooden construction.

2. Description of the Prior Art

The use of finishing caps is well known in the prior art. The prior art utilizes these caps for introduction into countersunk bores to mask the positioning of fastening structures, such as screws and the like, and to further provide a construction fastener when directed into appropriately positioned bores. Examples for the prior art include U.S. Pat. No. 4,602,971 to Bergeron wherein a patch member is provided for positioning and adhesively mounting over a hole in a paper web to prevent the hole from exposing underlying adhesive.

U.S. Pat. No. 4,255,475 to DelGrande wherein mosaic structures of flat or multi-dimensional configurations are provided with a plug arrangement effected by the securement of various panels together.

U.S. Pat. No. 4,460,087 to DeMarco, as well as DeMarco U.S. Pat. Nos. 4,484,715 and 4,547,417, provide a solid core plug including a cylindrical shape with a forwardly tapered end portion provided with a recess for accommodating a curved bar removal tool to remove the plug from which a cylindrical bore.

As such, it may be appreciated that there is a continuing need for a new and improved plug structure wherein the same addresses both the problems of ease of use and effectiveness in construction and in this respect, the present invention substantially fulfills this need.

SUMMARY OF THE INVENTION

In view of the foregoing disadvantages inherent in the known types of plug structures now present in the prior art, the present invention provides a plug structure wherein the same comprises a cylindrical base formed with variously configured head portions to minimize finishing steps required in wood cabinetry-type construction. As such, the general purpose of the present invention, which will be described subsequently in greater detail, is to provide a new and improved plug structure which has all the advantages of the prior art plug structures and none of the disadvantages.

To attain this, the present invention includes a structure comprising a cylindrical base member wherein the grain structure is aligned parallel to an axis defined by the cylindrical base, wherein various cap structures are provided, wherein each cap structure extends beyond the aforenoted cylindrical base and the cap structure extends beyond the aforenoted cylindrical base and the cap structures are defined by a square pyramidal structure, a square parallelepiped structure, a triangular pyramidal structure, as well as arcuate structures to enhance and minimize finishing steps required in the completion of wooden structures and enhance their value and aesthetic appeal. A modified plug structure utilizes radial compression grooves formed within the cylindrical base, wherein the compression grooves are provided with an adhesive that upon directing the base into a companion bore, directs the adhesive exteriorly of the grooves into communication with the bore to affix the plug with the bore.

My invention resides not in any one of these features per se, but rather in the perticular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures. methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims. nor is it intended to be limiting as to the scope of the invention in any way.

It is therefore an object of the present invention to provide a new and improved plug structure which has all the advantages of the prior art plug structures and none of the disadvantages.

It is another object of the present invention to provide a new and improved plug structure which may be easily and efficiently manufactured and marketed.

It is a further object of the present invention to provide a new and improved plug structure which is of a durable and reliable construction.

An even further object of the present invention is to provide a new and improved plug structure which is susceptible for a low cost of manufacture with regard to both materials and labor, and which accordingly is then susceptible of low prices of sale to the consuming public, thereby making such plug structures economically available to the buying public.

Still yet another object of the present invention is to provide a new and improved plug structure which provides in the apparatuses and methods of the prior art some of the advantages thereof, while simultaneously overcoming some of the disadvantages normally associated therewith.

Still another object of the present invention is to provide a new and improved plug structure wherein the same utilizes variously configured head members overlying a cylindrical body to minimize finishing steps required in cabinetry construction, as well as utilizing a modified cylindrical base member formed with compression grooves that are filled with an adhesive to permanently secure the plug to a bore surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a first plug structure utilized by the instant invention.

FIG. 2 is a top orthographic view of the plug structure of FIG. 1.

FIG. 3 is an orthographic view taken in elevation of the plug structure of FIG. 1.

FIG. 4 is a second plug structure utilized by the instant invention.

FIG. 5 is a top orthographic view of the plug structure of FIG. 4.

FIG. 6 is an orthograhic side view taken in elevation of the plug structure of FIG. 4.

FIG. 7 is a third plug structure organization illustrated in isometric of a plug structure organization utilized by the instant invention.

FIG. 8 is a top orthographic view of the plug structure of FIG. 7.

FIG. 9 is an orthographic side view taken in elevation of the plug structure of FIG. 7.

FIG. 10 is a fourth plug structure organization illustrated in isometric of a plug structure utilized by the instant invention.

FIG. 11 is a top orthographic view of the plug structure of FIG. 10.

FIG. 12 is an orthographic side view taken in elevation of the plug structure of FIG. 10.

FIG. 13 is an isometric illustration of a cabinet structure utilizing the plug structure of the instant invention.

FIG. 14 is an isometric illustration of a cabinet organization utilizing a cylindrical plug structure configuration.

FIG. 15 is an orthographic side view taken in elevation of a modified plug and base configuration utilized by the instant invention.

FIG. 16 is an orthograhic view taken along the line 16—16 of FIG. 15 in the direction indicated by the arrows.

DESCRIPTION OF THE PREFERRED EMBODIMENT

With reference now to the drawings, and in particular to FIGS. 1 to 16 thereof, a new and improved plug structure embodying the principles and concepts of the present invention and generally designated by the reference numerals 10, 14, 16, 19, and 24 will be described.

More specifically, the plug structure 10 essentially comprises a cylindrical boss 11 defined by an axis 11*a*, with a wood grain structure 12 aligned parallel to the axis 11*a*. A square base pyramidal cap 13 is dimensioned to extend beyond the cylindrical boss 11 to overlie a surface of a cabinet structure, for example as illustrated in FIG. 13 in use.

FIG. 4 through 6 illustrate a second plug structure 14 wherein a cylindrical boss 11 of equal construction to that of the plug structure 10 includes a square parallelepiped cap 15 mounted thereon. Similarly, FIGS. 7 through 9 illustrate a third plug structure 16 formed with a square cap member 17 defined by arcuate corners 18. FIGS. 10 through 12 define a fourth plug structure 19 formed as a triangular base pyramidal cap 20 overlying the cylindrical boss 11, wherein it should be noted that all of the cap members extend beyond a diameter defined by the boss 11. The plug structure are utilized in finish cabinetwork construction as illustrated in FIGS. 13 and 14. The uniquely dimensioned caps in use, as illustrated in FIG. 13 for example, minimize additional carpentry steps in blending the plug structure, such as in use of a cylindrical plug structure 23 in FIG. 14, in aesthetic conformance with an associated cabinet 22, as opposed to the use of the fourth plug structure 19 in a finishing procedure associated with a cabinet 21.

FIGS. 15 and 16 illustrate a modified plug structure 24 wherein a cap member 25 of any of the aforenoted caps, as illustrated per the plug structures of numerals 12, 14, 16, and 19, includes a base cylinder 26 with the grain structure 27 aligned parallel to the base cylinder axis 27*a*. The base cylinder is formed with radially aligned compression grooves 28 directed interiorly of the exterior surface of the base cylinder 26 in an annular array about the base cylinder in equally spaced intervals. The compression grooves 28 are of a generally triangular configuration with an apex oriented in a radially aligned fashion about the base cylinder 26 and extend from the bottom surface 29 of the base cylinder radially interiorly of the base cylinder substantially a distance one-half of a radius defined by the base cylinder 26 and extend upwardly parallel to the axis 27*a* a length greater than one-half of the predetermined length of the base cylinder, but terminating a distance below that of the upper end of the base cylinder, as illustrated in FIG. 15 for example. The compression grooves 28 are further provided with an adhesive 30 therewithin, whereupon a directing of the base cylinder 26 interiorly of an associated bore, as in a cabinet construction, will compress the compression grooves 28 and extrude the adhesive 30 exteriorly thereof for communication with associated walls of a bore to fixedly secure the plug structure 24 within such a bore for permanent association of the plug 24 with an associated cabinet.

As to the manner of usage and operation of the instant invention, the same should be apparent from the above disclosure, and accordingly no further discussion relative to the manner of usage and operation of the instant invention shall be preovided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A cellular plug structure for securement within a bore comprising, a cylindrical base member defined by a predetermined diameter and an axis, and a cap member orthogonally and fixedly secured to an upper end of said base member, said cap member defined by a predetermined width greater than said predetermined diameter, and the base member defined by a cellular grain structure parallel to said axis, and wherein the cap member is defined by a multi-faceted planar surface configuration, and wherein the base member includes a series of annular compression grooves directed radially and interiorly of said base member, and wherein the compression grooves are spaced at equal intervals about the base member and extend interiorly of the base member a distance substantially equal to one-fourth of said predetermined diameter, and wherein the compression grooves are defined by a predetermined height extending below said upper end of said base member, but greater than one-half of a predetermined axial length of said base member, and wherein the compression grooves are of a generally triangular, cross-sectional configuration, wherein each triangular groove is defined by an apex positioned interiorly of said base member, and wherein the compression grooves are filled with an adhesive therewithin for subsequent extrusion of said adhesive from said compression grooves into contact with said bore for fixedly securing said plug structure within said bore.

2. A cellular plug structure as set forth in claim 1 wherein said cap member is of a generally pyramidal configuration having a square base.

3. A cellular plug structure as set forth in claim 1 wherein said cap member is of a generally parallelepiped configuration having a square base.

4. A cellular plug structure as set forth in claim 1 wherein said cap member is defined by a generally square configuration with arcuate corners.

* * * * *